US005941325A

United States Patent [19]

Bækken et al.

[11] Patent Number: 5,941,325

[45] Date of Patent: Aug. 24, 1999

[54] PRESSURE CONVERTER (B)

[75] Inventors: Asbjørn Bækken; Tore Andersen; Sigmunn Strømm; Jan Skaar, all of Kongsberg, Norway

[73] Assignee: Den Norske Stats Oljeselskap A.S., Stavanger, Norway

[21] Appl. No.: 08/913,954

[22] PCT Filed: Mar. 5, 1996

[86] PCT No.: PCT/NO96/00051

§ 371 Date: Sep. 30, 1997

§ 102(e) Date: Sep. 30, 1997

[87] PCT Pub. No.: WO96/30619

PCT Pub. Date: Oct. 3, 1996

[30] Foreign Application Priority Data

Mar. 31, 1995 [NO] Norway ..... 951271

[51] Int. Cl.[6] ..... E21B 4/00

[52] U.S. Cl. ..... 175/93; 175/107

[58] Field of Search ..... 175/92–94, 100, 175/106, 107

[56] References Cited

U.S. PATENT DOCUMENTS

| | | | |
|---|---|---|---|
| 4,047,581 | 9/1977 | Erickson | 175/95 |
| 4,711,309 | 12/1987 | Knight et al. | 175/93 |
| 5,246,080 | 9/1993 | Horvei et al. | 175/93 |
| 5,361,857 | 11/1994 | Horvei | 175/93 |
| 5,375,671 | 12/1994 | Horvei | 175/93 |
| 5,577,564 | 11/1996 | Le | 175/93 |

FOREIGN PATENT DOCUMENTS

| | | |
|---|---|---|
| 0 335 543 | 10/1989 | European Pat. Off. . |
| 169088 | 5/1992 | Norway . |
| 171322 | 2/1993 | Norway . |
| 171323 | 2/1993 | Norway . |
| 171325 | 2/1993 | Norway . |
| 91/07566 | 5/1991 | WIPO . |
| 92/08871 | 5/1992 | WIPO . |
| 92/08872 | 5/1992 | WIPO . |

*Primary Examiner*—Roger Schoeppel
*Attorney, Agent, or Firm*—Foley & Lardner

[57] ABSTRACT

Pressure converter for mounting above the drill bit at the lower end of a drill pipe for generating a higher fluid pressure in a portion of a drilling fluid flow, including a piston which is moveable in a cylinder. The piston has a large piston area which when moved in a first direction is affected by the pressure of the drilling fluid in the drill pipe, and an opposite small piston area which when moved in the first direction provides an increased pressure in a smaller portion of the drilling fluid flow. A valve arrangement controls the movement of the piston in the cylinder. Conduits communicate with drilling fluid flow passages inside the drill pipe and the annulus outside the drill pipe respectively. The space in front of the small piston area is adapted to receive a particular working fluid and there is provided a moveable membrane so as to separate the working fluid from the drilling fluid.

5 Claims, 1 Drawing Sheet

PRESSURE CONVERTER (B)

BACKGROUND OF THE INVENTION

1. Field of the Invention

This invention relates to an improved design of a pressure amplifier or pressure converter for mounting above the drill bit at the lower end of a drill pipe for deep drilling, in particular for oil and gas, and for generating an increased fluid pressure by utilizing energy in a drilling fluid flow downwards through the drill string and the drill pipe. This can be done for the purpose of obtaining an enhanced drilling effect, preferably by means of one or more high pressure jets adapted to have a cutting effect in a surrounding rock formation.

2. Description of the Related Art

The invention can be considered as a further development and improvement of structures described in Norwegian patent specifications Nos. 169.088, 171.322, 171.323 and 171.325. It has now been found that these and other known pressure converters advantageously can be replaced by or modified into new and improved designs to be described in the following description. These new designs involve among other things, an improved reliability and a reduced wear and tear of important parts of the pressure converters.

SUMMARY OF THE INVENTION

Like the pressure converters according to the above Norwegian patent specifications, the present invention as a starting point takes an embodiment comprising a reciprocating piston which is moveable under the influence of drilling fluid pressure, between opposite end positions in a cylinder. At one side the piston has a relatively large piston area which during piston movement in a first direction is influenced by the drilling fluid pressure in the drill pipe, and an oppositely facing, relatively small piston area, which during piston movement in the first direction generates an increased pressure in a smaller portion of the drilling fluid flow. Valve means control the movement of the piston in the cylinder, and conduits are provided to communicate with drilling fluid flow passages within the drill pipe and the annulus outside the drill pipe, where the drilling fluid has a relatively low pressure. A high pressure conduit with a check valve connects the space in front of the small piston area to a header conduit for drilling fluid at the increased pressure.

What is novel and specific to the pressure converter according to the invention in the first place consists therein that the space in front of the small piston area is adapted to receive a particular working fluid and that there is provided a moveable membrane for separating between the working fluid and the drilling fluid.

BRIEF DESCRIPTION OF THE DRAWINGS

The novel structural solutions according to the invention as well as additional advantages and particular features thereof, shall be explained more closely in the following description with reference to the drawings, where.

DESCRIPTION OF SPECIFIC EMBODIMENTS

Since the present pressure converter as far as the main features thereof are concerned, is closely related to corresponding structures according to the Norwegian patent specifications referred to above, it seems sufficient here only briefly to discuss these main features and functions.

Figure 1:
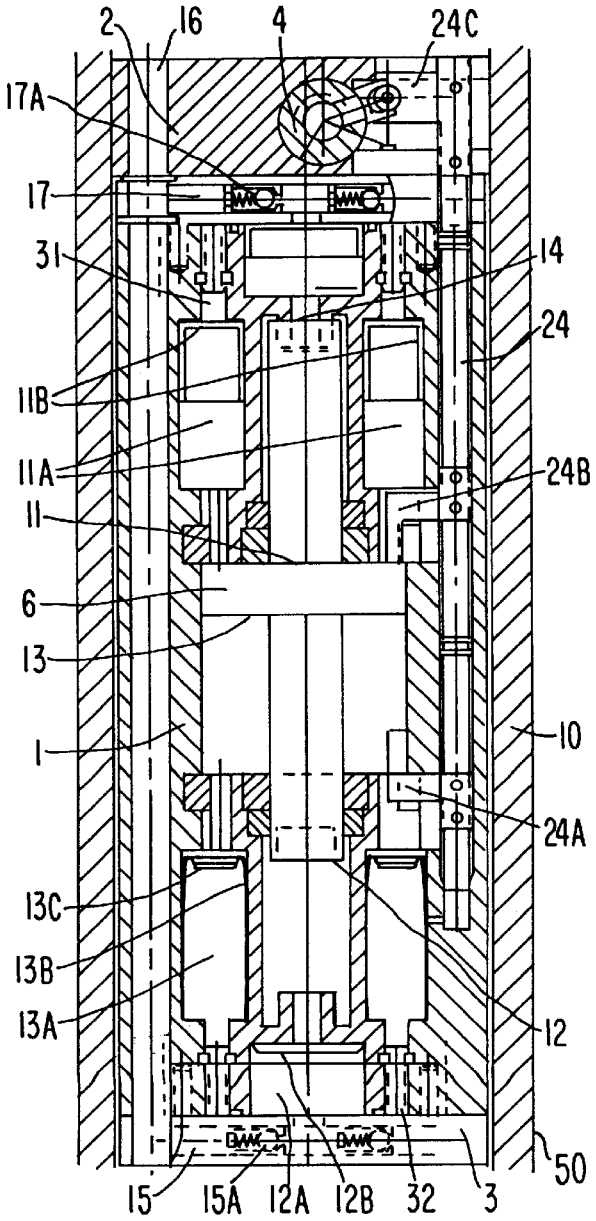
FIG. 1 in longitudinal section shows a first embodiment of a pressure converter according to the invention, with the piston in an upper end position, and FIG. 2 in longitudinal section shows another embodiment of the pressure converter according to the invention, with the piston in an upper end position.

As in the previously proposed structures the embodiment of FIG. 1 comprises as substantially cylindrical housing 1, 2, 3 adapted to enclose a piston 6. This has several active piston areas here, i.e. in the first place an upper relatively large piston area 11, a second and opposite large piston area 13 and an opposite, relatively small piston area 12 at the lower end of piston member 6. This is adapted to be freely moveable axially under the influence of varying drilling fluid pressures at the respective piston areas.

The space or volume in front of piston area 11 can be designated low pressure space, whereas the volume in front of piston area 12 correspondingly can be designated high pressure space. This latter space is connected through a conduit 15 with a check valve 15A, to a header conduit 16 for the resulting drilling fluid flow at an increased pressure. Conduit 16 runs through the whole longitudinal direction of the housing, i.e. the cylinder wall 1, for the purpose of interconnecting several of these pressure converter unit to a group in the same manner as in the Norwegian patent specifications mentioned above.

In addition to the main part of piston 6 with the two relatively large piston areas 11 and 13 as well as the high pressure piston 12, the embodiment of FIG. 1 has an extension upwards ending at a second, relatively small piston area 14 which is facing oppositely in relation to said first small piston area 12. During piston movement upwards caused by piston area 13 upon application of drilling fluid from the drill pipe against it, there is accordingly delivered drilling fluid at an increased pressure through a second high pressure conduit 25 with an associated check valve 25A leading forward to the header conduit 16 mentioned above. Thus the pressure converter will have a working stroke both upwardly and downwardly, so that a return stroke without an actual pressure increasing effect as in the previously known designs referred to above, does not occur here.

In order to control the drilling fluid into and out of the cylinder for driving the piston 6 upwards and downwards as explained above, the embodiment of FIG. 1 shows valve means adapted to be influenced by the large piston areas 11 and 13 at the respective end positions of the piston. The valve means comprises a valve or slide rod 24 being displaceable in an associated bore parallel to the cylinder axis. On the rod 24 there are attached brackets 24A and 24B having such an angular shape and extension that end portions of these brackets can project into the cylinder and be influenced by piston areas 11 and 13 in the respective end positions of piston 6. Thus in the position illustrated in FIG. 1 piston area 11 has pushed bracket 24B and thereby rod 24 upwards to an upper position, whereas the lower bracket 24A has its end portion projecting into the space in front of piston area 13. When piston 6 approaches its lower end position bracket 24A therefore will provide for movement of rod 24 and in turn a rotary valve 4 being provided in the upper end member 2 of the cylinder. The valve 4 is rotated between two angular positions by means of a transvers arm 24C at the upper end of slide rod 24. The rotary valve 4 serves to control drilling fluid flows from the interior of the drill pipe 10 for pressure actuation of piston 6, and outflow of drilling fluid to annulus 50 respectively, so that the desired reciprocating movement of piston 6 is obtained. The above previous patent specifications show various designs of such control valves, and it does not seem necessary here to describe valve 4 more in detail.

At this point reference is also made to the simultaneous international patent application directed to a pressure converter (our ref: INT6016L) filed on behalf of the same applicant, where the actual piston arrangement in the cylinder and certain other features rather closely correspond to what is discussed above with reference to FIG. 1.

What is the main point in the present invention is that there is provided a moveable membrane, possibly several membranes, for separating between the drilling fluid and a particular working fluid being received in cylinder 1,2,3, so that only this working fluid is in contact with vital parts of the mechanism, i.e. primarily the piston 6 with its various piston areas. Such a moveable membrane is provided at least in a chamber 12A and 14A respectively, communicating with the space in front of piston areas 12 and 14 respectively, viz. on the high pressure side of piston 6. More particularly from FIG. 1 it appears that the membrane 14B in chamber 14A is urged up to an upper end position whereby drilling fluid under high pressure is pressed out through the high pressure valve 17A and the high pressure conduit 17 to the header conduit 16. In a corresponding way the membrane 12B in the lower chamber 12A has been brought into an upper position under the influence of drilling fluid pressure at the underside, ready for a return stroke in downward direction upon successive piston movement downwards, so that piston area 12 will press working fluid in the space in front of this piston area downwards against membrane 12B which will thereby be moved downwards and at its underside further urge drilling fluid to pass through high pressure valve 15A.

Membranes 12B and 14B as just described, are shown in this embodiment as so-called roller membranes, these being components known per se from other types of equipment and structures. Moveable membranes in the pressure converter in FIG. 1 has particular interest at the high pressure side, where roller membranes 12B and 14B are provided in spaces in front of the small piston areas 12 and 14.

In addition to membranes 12*b* and 14B FIG. 1 also shows roller membranes 11B and 13B arranged in respective annular chambers 11A and 13A communicating with spaces in front of the large piston areas 11 and 13 respectively, on piston 6. At the other side these annular chambers 11A and 13A communicate through conduits 31 and 32 with valve 4 so that this can alternately apply pressure at the upper side and underside of main piston 6 for the previously described reciprocating movement. In a corresponding way as roller membranes 12B and 14B, the further roller membranes 11B and 13B thus separate between drilling fluid flowing through conduits 31 and 32 at the one side, and said working fluid at the other side, i.e. that side which communicates directly with the space in front of the large piston areas 11 and 13.

As shown specifically for roller membrane 13B this can be provided with a stiffening ring or plate 13C at its central part, for in a manner known per se to contribute to a desired and more secure rolling movement of the membrane between its two end positions.

With the special shape of piston 6, comprising the extensions upwards and downwards respectively, for the high pressure piston areas 14 and 12, it is convenient with the location of membrane chambers 11A and 13A as shown, i.e. radially outward of each associated space in front of these piston areas 12 and 14. As will be seen from the drawing these are located centrally and axially in the cylinder-piston structure.

In this embodiment membrane chambers 11A and 13A are annular, with a corresponding configuration of the associated roller membranes 11B and 13B, but it is obvious that a number of cylindrical and separate membrane chambers could replace each such annular chamber.

It is most practical to locate the chambers 12A and 14A for roller membranes 12B and 14B at the high pressure side, axially outwards from each of the small piston areas 12 and 14. Then there is obtained a direct and advantageous connection to the respective high pressure valves 15A and 17A with high pressure conduits 15 and 17.

Typically as a working fluid there will be employed a hydraulic liquid of a suitable and commercially available type. When the vital parts of the mechanism, in particular piston 6 and the various glide and piston surfaces, operate in such a clean hydraulic liquid and separate from the drilling fluid, a more reliable and dependable pressure converter apparently is obtained.

Obviously the exemplary embodiment shown in FIG. 1 can be varied in many ways without departing from the essential separation between working fluid and drilling fluid. As mentioned such modifications can relate to for example the valve 4, the arrangement and position of membrane chambers and so forth. As a particular detail it is mentioned here that end dampers can be provided in association with the small high pressure piston areas 12 and 14.

Figure 2:
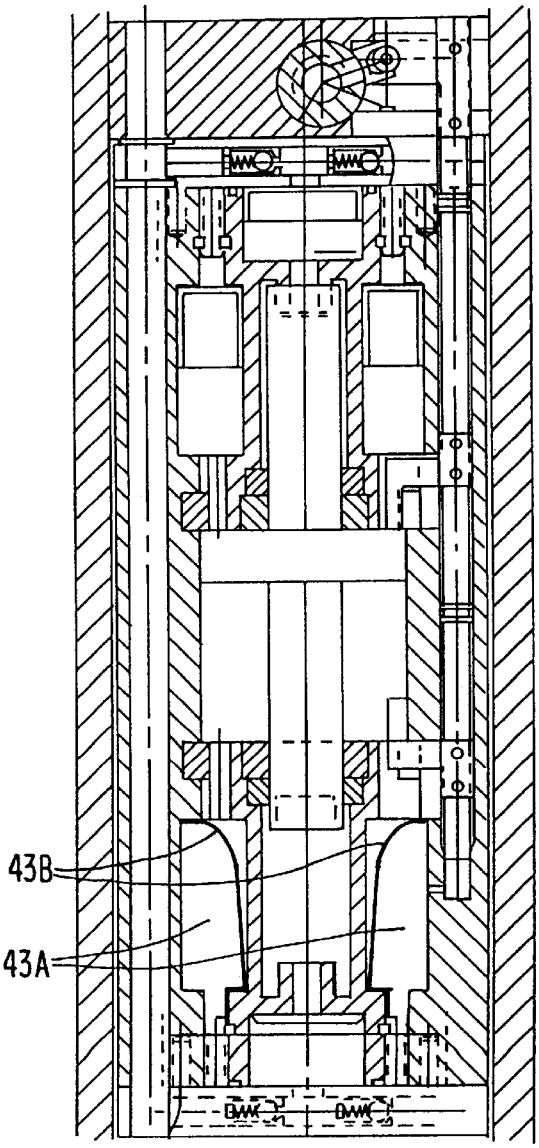

A modification of particular interest is illustrated in FIG. 2, which is substantially correspondent to the embodiment of FIG. 1, except for the moveable membrane 43B in the lower annular membrane chamber 43A. Whereas this membrane chamber 43A in its design completely corresponds to annular chamber 13A in FIG. 1, membrane 43B is not a roller membrane as membrane 13B, but a substantially cylindrical membrane being adapted to move generally radially in chamber 43A. In the position shown in FIG. 2 membrane 43B to a large extent lies against the radially inner cylinder wall in chamber 43A, corresponding to the piston position shown, i.e. an upper position as in FIG. 1. When the piston is moved downwards membrane 43A will be urged radially upwards by the working fluid so as to be engaged more or less against the outer cylinder wall of chamber 43A, while drilling fluid at the outside of membrane 43 is simultaneously pressed out downwards through the conduit or conduits 32 (see FIG. 1).

It is obvious that in the embodiment of FIG. 2 the annular membrane chamber above the main piston could also be provided with a generally cylinder-like membrane corresponding to the membrane 43B.

We claim:

1. A pressure converter for mounting above a drill bit at the lower end of a drill pipe for deep drilling, in particular for oil and gas, and for generating an increased fluid pressure by utilizing energy in a drilling fluid flow downwards through the drill string and the drill pipe, comprising:

a reciprocating piston which under the influence of drilling fluid pressure is moveable between opposite end positions in a cylinder, the piston having at one side a relatively large piston area which during piston movement in a first direction is influenced by the drilling fluid pressure in the drill pipe, and an oppositely facing, relatively small piston area which during the piston movement in the first direction generates an increased pressure in a portion of the drilling fluid flow, valve means for controlling the piston movement in the cylinder, conduits which communicate with drilling fluid flow passages within the drill pipe and an annulus outside the drill pipe, where the drilling fluid has a relatively low pressure, and a high pressure conduit with a check valve for connecting the space in front of the small piston area to a header conduit for drilling fluid at the increased pressure, the space in front of the small piston area being adapted to receive a working fluid and provided with a moveable membrane for separating the working fluid and the drilling fluid, wherein the space in front of the large piston area is adapted to receive the working fluid and that there is provided at least two further moveable membranes for separating the working fluid and drilling fluid in the conduits.

2. The pressure converter according to claim 1 wherein for each further moveable membrane in the conduits there is provided a membrane chamber communicating at one side with the cylinder and communicating at the other side with at least one of the conduits.

3. The pressure converter according to claim 2 wherein the piston is provided with a second relatively large piston area facing oppositely in relation to the first mentioned large piston area and adapted to be influenced by the drilling fluid pressure in the drill pipe so as to move the piston in another, opposite direction of said first direction, further comprising a second relatively small piston area facing oppositely in relation to the first mentioned small piston area facing oppositely in relation to the first mentioned small piston area and adapted to generate an increased drilling fluid pressure during piston movement in the other, opposite direction, further comprising a second high pressure conduit with a second check valve serving to connect the space in front of the second, opposite small piston area to the header conduit, and wherein the membrane chambers at least in part are located radially outside each of the spaces respectively, in front of the small piston areas, the spaces having an axially central position in the pressure converter.

4. The pressure converter according to claim 3 wherein the membrane chambers have an annular shape about an axis coinciding with the axis of the cylinder and the axis of the piston.

5. A pressure converter for mounting above a drill bit at the lower end of a drill pipe for deep drilling, in particular for oil and gas, and for generating an increased fluid pressure by utilizing energy in a drilling fluid flow downwards through the drill string and the drill pipe, comprising:

a reciprocating piston which under the influence of drilling fluid pressure is moveable between opposite end positions in a cylinder, the piston having at one side a relatively large piston area which during piston movement in a first direction is influenced by the drilling fluid pressure in the drill pipe, and an oppositely facing, relatively small piston area which during the piston movement in the first direction generates an increased pressure in a portion of the drilling fluid flow, valve means for controlling the piston movement in the cylinder, conduits which communicate with drilling fluid flow passages within the drill pipe and an annulus outside the drill pipe, where the drilling fluid has a relatively low pressure, and a high pressure conduit with a check valve for connecting the space in front of the small piston area to a header conduit for drilling fluid at the increased pressure, the space in front of the small piston area being adapted to receive a working fluid and provided with a moveable membrane for separating the working fluid and the drilling fluid, the membrane being in the form of a roller membrane.

* * * * *